US005741129A

United States Patent [19]

Li

[11] Patent Number: 5,741,129

[45] Date of Patent: Apr. 21, 1998

[54] IGNITING AND SENSING FLAME ON A FUEL GAS BURNER

[75] Inventor: Ceji Li, Carol Stream, Ill.

[73] Assignee: Ranco Incorporated of Delaware, Wilmington, Del.

[21] Appl. No.: 780,021

[22] Filed: Dec. 23, 1996

[51] Int. Cl.[6] ..... F23Q 3/00

[52] U.S. Cl. ..... 431/264

[58] Field of Search ..... 431/263, 264, 431/266

[56] References Cited

U.S. PATENT DOCUMENTS 3,352,346 11/1967 Temple ..... 431/266

4,582,475 4/1986 Hoppie ..... 431/264

*Primary Examiner*—Carroll B. Dority

*Attorney, Agent, or Firm*—Roger A. Johnston

[57] ABSTRACT

A system and method for igniting gaseous fuel-air mixture flowing from flame generating ports in a burner tube having a plate welded to the side of the tube and extending from the tube in close proximity to one of the flame ports. The plate has a cut-out or aperture which forms a plenum which reduces the flow velocity and the plate is electrically grounded. A spark electrode has one end disposed in the aperture and upon application of a high voltage potential to the electrode a spark is discharged to the aperture and the mixture in the plenum is ignited and a portion of the resultant flame retained in the plenum aperture for current rectification sensing of flame presence.

7 Claims, 3 Drawing Sheets

IGNITING AND SENSING FLAME ON A FUEL GAS BURNER

BACKGROUND OF THE INVENTION

The present invention relates to the ignition of a fuel gas-air mixture on a burner, such as used in an oven and has particular applicability to igniting such a mixture in an oven used for household cooking, particularly of the type produced in high volume for residential kitchens. Heretofore, ignition of fuel gas-air mixture in oven burners has been performed generally in one of two ways: (a) providing a glowing hot surface igniton adjacent the burner port and permitting the fuel gas-air mixture to impinge upon the glowing surface of the ignitor to be raised to ignition temperature to ignite the flame, (b) providing a high voltage spark discharge in the path of the fuel gas-air mixture flowing from the burner port. The spark discharge manner of igniting fuel gas-air mixture has found widespread usage because of the relatively low manufacturing cost and ease of assembly of the components in the oven and the minimum of space required for such a spark discharge ignitor in the region surrounding the burner.

However, problems have been encountered in igniting a fuel gas-air mixture flowing from a burner port with a spark ignitor because of the relatively high velocity of the mixture discharging from the burner port and from spark erosion of single point electrode sparking. Problems have also been encountered with alignment of the electrodes both during manufacture and in maintaining alignment during service life resulting erratic sparking and unreliable ignition. The flame generating ports must be maintained to a minimal size to prevent generation of oversized flames which are difficult to control and which have a tendency to burn rich resulting in hydrocarbon formation in the form of soot in the oven. Therefore, the burner flame generating ports are designed to a relatively small diameter; and, this results in a relatively high velocity of the fuel gas-air mixture discharging from the port. The relatively high velocity of the mixture discharging from the port makes it quite difficult to place a spark ignitor in the proper location for igniting flame as the mixture initially discharges from the port upon opening of the burner flow control valve.

Thus it has long been desired to provide a way or means of improving the initiation of flame at a burner discharge port utilizing a spark discharge type ignitor and to provide such improvement without increasing the manufacturing cost of the ignitor components.

BRIEF SUMMARY OF THE INVENTION

It is an object of the present invention to provide an improved spark discharge type ignitor for igniting a fuel gas-air mixture discharging from a burner port.

It is a further object of the present invention to provide a spark discharge type ignitor system for igniting fuel gas flowing from a burner port and to provide such a system having multiple sparking electrode surfaces which are equidistant from the high voltage potential electrode. It is a further object of the present invention to provide flame presence sensing by current rectification in the presence of flame.

The present invention provides a plenum area adjacent the burner discharge port and an electrode is disposed in the plenum area for providing spark discharge thereto for igniting the fuel gas-air mixture discharging from the burner port. In the preferred embodiment, the plenum is formed as a cut-out or aperture in a plenum member attached to the burner; and, the periphery of the plenum aperture provides multiple points for spark discharge which are equidistant from an electrode centrally disposed with respect to the aperture. In one embodiment the aperture formed at generally right angles to the direction of flow from the burner port. In another embodiment the plenum aperture is disposed in a plate generally parallel to the burner flame generating port surface. A portion the flow from the burner port is trapped in the plenum aperture and the velocity is reduced such that upon spark discharge the fuel gas-air mixture is readily ionized and ignited by the spark discharge.

Upon ignition, the plenum aperture surrounding the electrode tip tends to direct and hold flame about the electrode and enhances flame rectification for flame presence sensing.

DETAILED DESCRIPTION OF THE INVENTION

Figure 1:
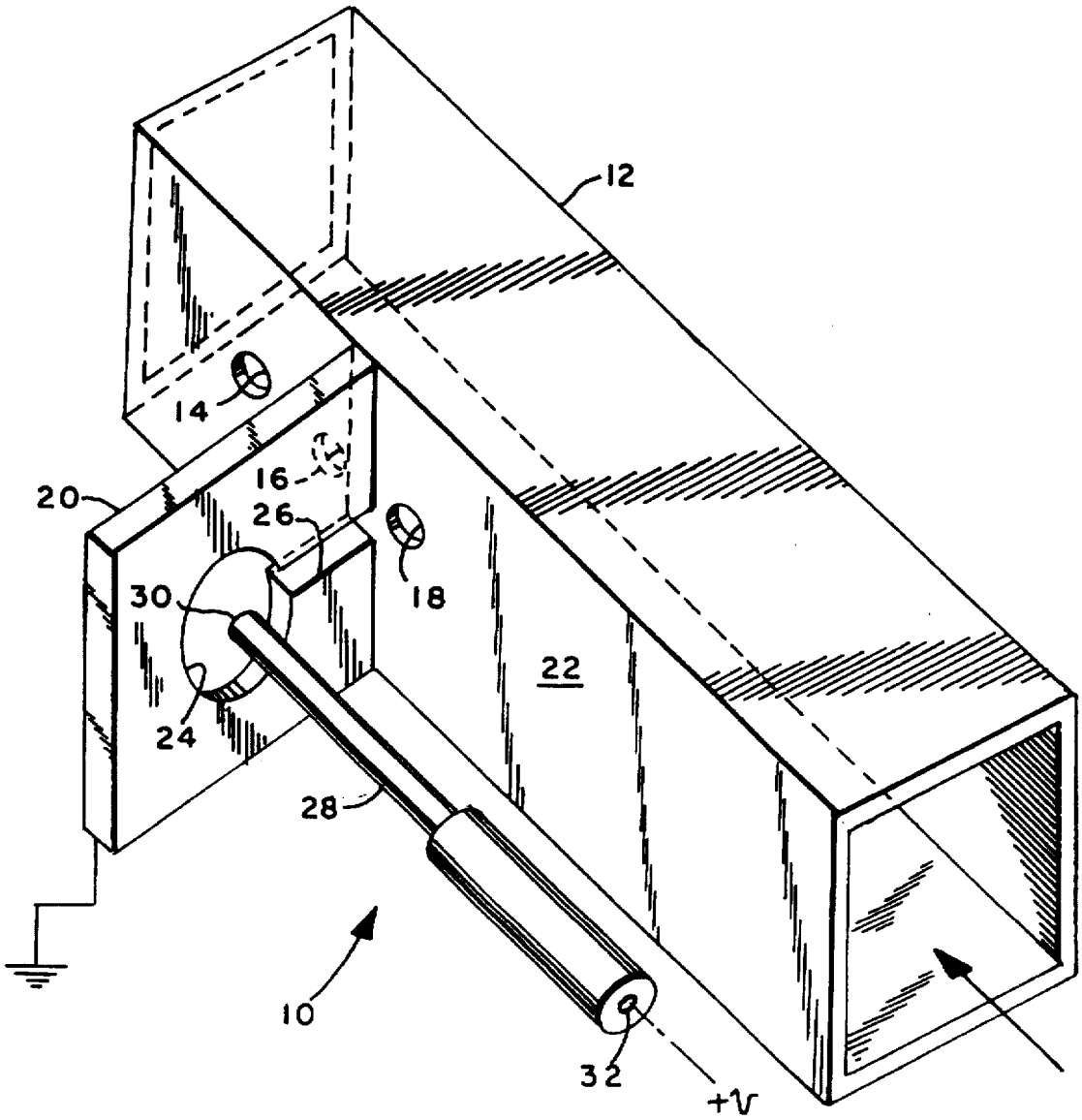
FIG. 1 illustrates in axonometric projection a portion of a fuel burner tube with the plenum aperture disposed at right angles to the flow from flame generating ports.
Figure 2:
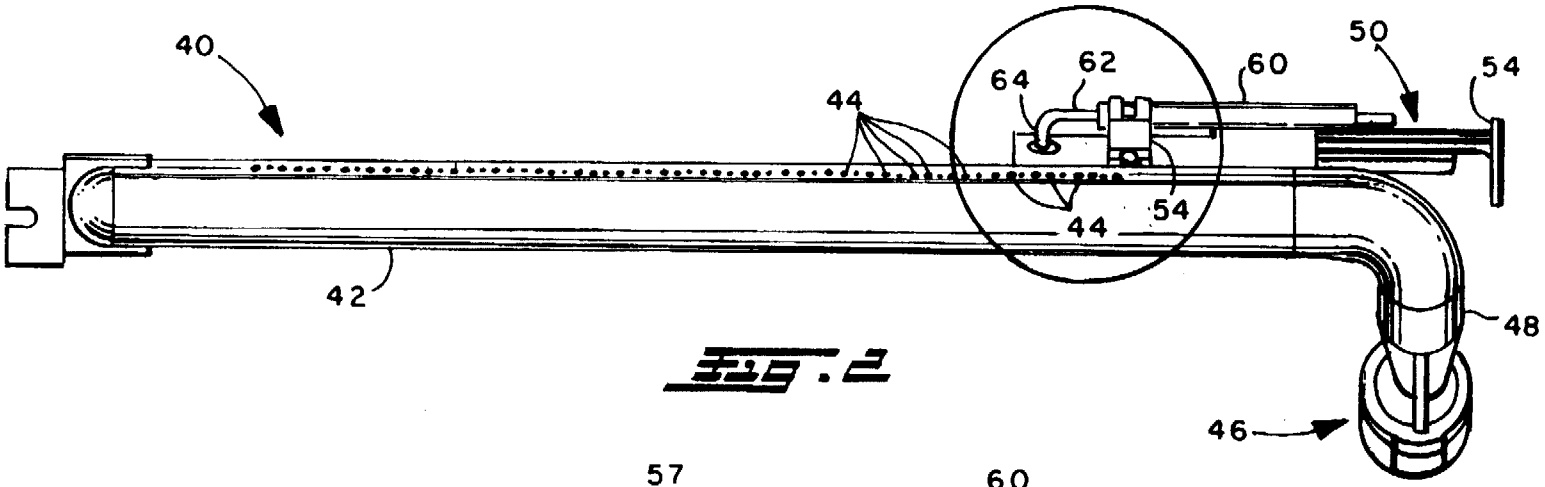
FIG. 2 is a front side elevation view of another preferred embodiment of the invention having the plenum aperture in a plate parallel to the flame generating port surface.
Figure 3:
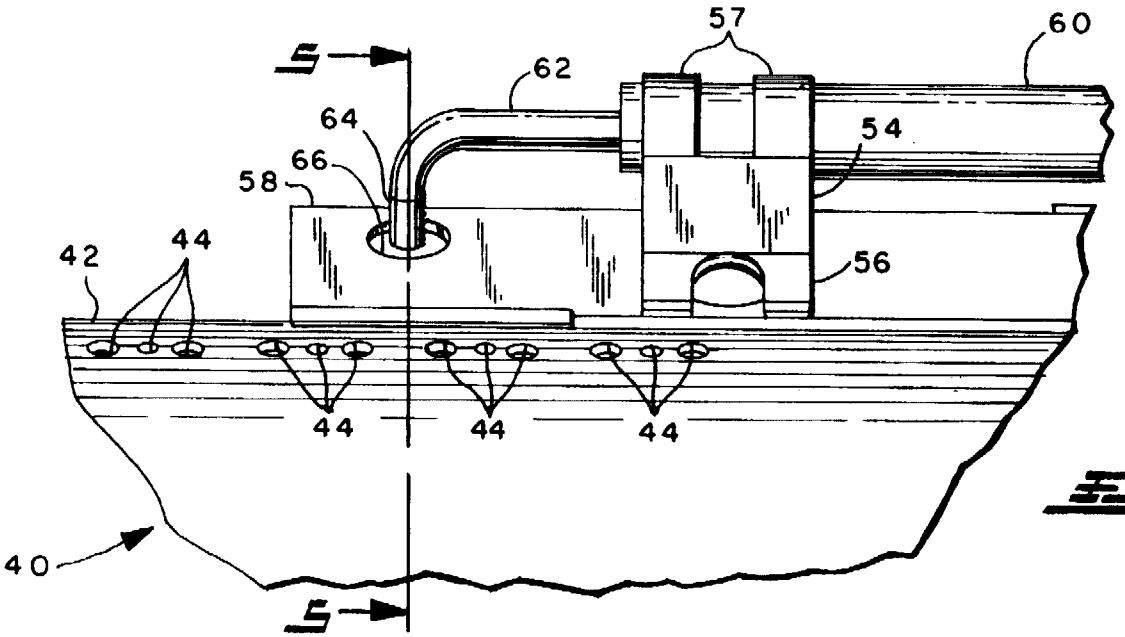
FIG. 3 is an enlarged view of the encircled portion of FIG. 2.
Figure 4:
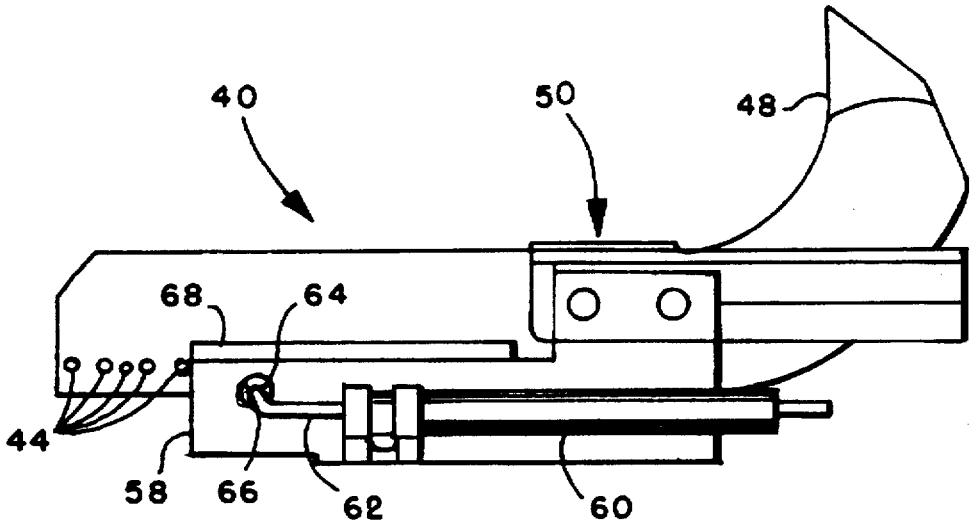
FIG. 4 is a top or plan view of the right end portion of FIG. 2.
Figure 5:
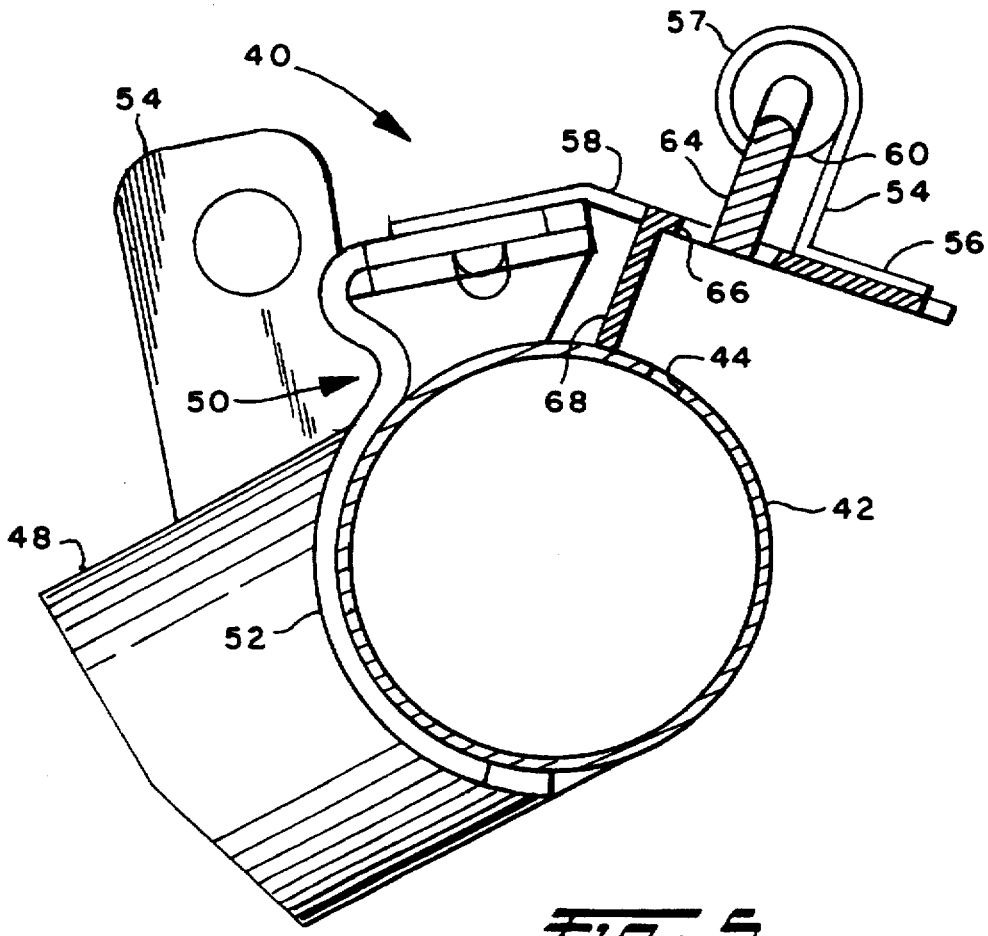
FIG. 5 is a section view taken along section indicating lines 5—5 of FIG. 3.

Referring to FIG. 1, one embodiment of the ignitor system is indicated generally at 10 and includes a burner tube 12, such as an oven burner, which has the hollow interior thereof formed to receive a supply of gaseous fuel-air mixture from a source (not shown) which enters the burner tube 12 from the direction indicated by the black arrow. A plurality of flame generating ports indicated by reference numerals 14, 16, 18 are provided in spaced generally aligned relationship along one sidewall of the burner tube 12, which in the illustrated embodiment has a generally rectangular or square cross-section. It will be understood however that the burner port may have any suitable configuration such as, for example, a circular or oval cross-section. The burner tube in the illustrated embodiment has a seamless configuration but may also be fabricated by joining together half shells as, for example, by weldment.

A plenum forming member in the form of plate 20 has one side thereof attached to the wall 22 of the burner and is disposed in closely spaced proximity to the burner port 18. The plenum forming plate 20 has a plenum cut-out 24 formed therein which has a slot 26 formed in one side thereof, which slot 26 extends to the burner wall 22 such that a portion of the gaseous fuel-air mixture emanating or flowing from port 18 travels along the slot into the plenum area 24. In the present practice of the invention, the cut-out 24 has a generally circular configuration; and, the plate 20 is welded to the wall 22 of the burner tube such that the plate extends therefrom in a generally right angle configuration. This arrangement serves to trap and reduce the velocity of at least a portion of the fuel-air mixture flowing from flame generating port 18.

An electrode 28 is disposed adjacent the cut-out 24 and preferably has the end 30 thereof disposed centrally within the circular cut-out 24 such that the periphery of the cut-out is equidistant from the end 30 of the electrode. The distal or remote end of the electrode denoted by reference numeral 32 is connected to a source of relative high voltage electrical potential with respect to the plate 20, which in the present practice of the invention is grounded.

It will be understood that upon initiation of the flow of gaseous fuel-air mixture into the hollow of burner 12, the mixture flows at an increased velocity through the ports 14, 16, 18, with the flow from port 18 entering the slot 26 and circular aperture 24 where the velocity is reduced. Upon the oven user actuating a control (not shown) a high voltage (+v) is applied to electrode 28 and an arc or spark discharge from the end 30 of the electrode to the periphery of the cut-out 24 and ignition occurs and flame is generated at the port 18. It will be understood that the plate 20 may be located intermediate the ports 16 and 18 such that flame will be initiated practically simultaneously at ports 16 and 18.

Referring to FIGS. 2 through 5, another embodiment of the system is illustrated generally at 40 and includes a burner tube 42 having a plurality of flame generating ports 44 provided thereon and an inlet air aspirator indicated generally at 46 which is provided on an end 48 of the tube formed at right angles to the tube 42.

A burner support mounting member indicated generally at 50 has a portion thereof indicated by reference numeral 52 configured to conform to the outer surface of tube 42 and is attached thereto by any suitable expedient, as for example, weldment. The burner mounting support member 50 includes a flange 54 for mounting the burner tube to the interior of the oven.

An ignitor support bracket 54 is attached to the support member 50 by any suitable expedient such, as for example, weldment or riveting of a flange portion 56 welded to a plate 58 which comprises a portion of the burner tube support member 50. A portion of the ignitor bracket 54 distal the flange 56 is formed to a generally circular configuration as denoted by reference numeral 57 and has received therein an ignitor probe 60 which is securely clamped therein and maintained in a predetermined position.

The ignitor probe 60 has an electrode 62 extending from the end thereof which electrode is formed in a generally right angle bend to have an end 64 thereof disposed, preferably centrally, within an aperture 66 formed in the plate 58 which is disposed and located such that aperture 66 is positioned over at least one of the burner flame generating ports 44 and is spaced therefrom a predetermined distance by a flange 68 formed on plate 58.

Thus, upon opening of a fuel valve (not shown) fuel enters aspirator 46 and a mixture of gaseous fuel and air flows in tube 42 and discharges from the ports 44 and a portion thereof is contained in the region of the cut-out 66. Upon spark discharge of the ignitor end 64 to multiple points about the periphery of circular cut-out or aperture 66, the mixture is ignited and flame is retained in the aperture 66. The flame retained in the aperture 66 is utilized to rectify a current flowing from electrode end 64 to aperture 66, which rectification may be sensed by suitable circuitry (not shown) in a manner well known in the art and thus the ignitor arrangement provides an inherent flame sensing ability to the ignition system of the present invention. It will be understood that although a circular configuration for aperture 66 is preferred to provide an enlarged spark discharge area equidistant from the electrode end 64, that other configurations for the aperture 66 may be employed as, for example, oval, elliptical, elongated slot or an open U-shaped cut-out.

The present invention thus provides an improved spark discharge type ignition system for igniting fuel gas-air mixture flowing from burner ports and has particular applicability to burner tubes of the type employed for household cooking ovens.

The present invention provides for multiple discharging of the sparking to a plurality of surface points by placement of the spark electrode in an aperture or cut-out which serves to retain flame when the fuel-air mixture from the flame generating port is ignited. The flame retained in the cut-out or aperture is then utilized to rectify a flow of sensing current which rectification is sensed to give proof of flame presence.

Although the present invention has hereinabove been described with respect to the illustrated embodiments, it will be understood that the invention is capable of modification and variation and is limited only by the following claims.

I claim:

1. A spark ignition system for a gaseous fuel burner comprising:

(a) a burner member connected for receiving a flow of fuel gas-air mixture and having at least one flame generating port formed thereon;

(b) support structure associated with said burner adjacent said at least one port, said support having a cut-out therein relatively closely spaced to said port; and, (c) an electrode disposed in said cut-out and defining an air gap therebetween, wherein said cut-out substantially surrounds said electrode, wherein upon application of a high-voltage potential to said electrode, a spark is discharged to said cut-out effacing ignition of said gaseous fuel from said at least one port, wherein said flame is retained in said cut-out and provides rectification of a sensing current which rectification is detectable for proof of flame presence.

2. The ignition system defined in claim 1, wherein said cut-out has a generally circular configuration.

3. The ignition system defined in claim 1, wherein said burner has a tubular configuration; and, said support structure comprises a plate attached to the wall of said tubular burner.

4. A method of igniting a gaseous fuel-air mixture flowing from a burner port comprising:

(a) providing a hollow burner having at least one flame generating port therein and flowing a gaseous fuel-air mixture through said port;

(b) disposing a plenum member adjacent said port and forming a plenum cut-out in said member;

(c) disposing an electrode in said cut-out and defining an air gap therebetween;

(d) applying a relatively high voltage potential to said electrode with respect to said plenum member and discharging a spark therebetween and igniting said fuel gas-air mixture; and, (e) retaining at least a portion of the flame therefrom in said cut-out for current rectification flame sensing.

5. The method defined in claim 4, wherein said step of disposing includes attaching said plenum member to said burner.

6. The method defined in claim 4, wherein said step of disposing includes providing a plate; and, said step of forming a cut-out includes forming a generally circular aperture in said plate.

7. The method defined in claim 4, wherein said step of forming a cut-out includes forming a generally circular aperture; and, said step of disposing an electrode includes positioning the end of said electrode centrally in said circular aperture.

* * * * *